US008540456B2

(12) United States Patent
Marshall

(10) Patent No.: US 8,540,456 B2
(45) Date of Patent: Sep. 24, 2013

(54) CONTAINMENT SYSTEM

(71) Applicant: Polystar Incorporated, Twinsburg, OH (US)

(72) Inventor: Aaron D. Marshall, Uniontown, OH (US)

(73) Assignee: Polystar Incorporated, Twinsburg, OH (US)

( * ) Notice: Subject to any disclaimer, the term of this patent is extended or adjusted under 35 U.S.C. 154(b) by 0 days.

(21) Appl. No.: 13/667,429

(22) Filed: Nov. 2, 2012

(65) Prior Publication Data

US 2013/0105475 A1 May 2, 2013

Related U.S. Application Data

(63) Continuation of application No. 13/282,923, filed on Oct. 27, 2011.

(51) Int. Cl.
*E02B 7/08* (2006.01)

(52) U.S. Cl.
USPC ..... 405/114; 405/107; 405/110

(58) Field of Classification Search
USPC ..... 405/107, 110, 114; 52/169.7
See application file for complete search history.

(56) References Cited

U.S. PATENT DOCUMENTS

| | | | | |
|---|---|---|---|---|
| 4,031,676 | A | 6/1977 | Dally | |
| 4,146,344 | A | 3/1979 | Steen et al. | |
| 4,663,207 | A | 5/1987 | Kupersmit | |
| 4,681,302 | A | 7/1987 | Thompson | |
| 4,765,775 | A | 8/1988 | Kroger | |
| 4,865,213 | A | 9/1989 | Kruger | |
| 4,869,617 | A | 9/1989 | Chiodo | |
| 4,993,565 | A | 2/1991 | Ota et al. | |
| 5,176,468 | A | 1/1993 | Poole | |
| RE34,691 | E | 8/1994 | White | |
| 5,425,594 | A | 6/1995 | Krage et al. | |
| 5,429,437 | A | 7/1995 | Shaw et al. | |
| 5,454,195 | A | 10/1995 | Hallsten | |
| 5,632,573 | A | 5/1997 | Baker | |
| 5,689,920 | A | 11/1997 | Hallsten | |
| 5,924,461 | A | 7/1999 | Shaw et al. | |
| 5,984,577 | A | 11/1999 | Strong | |
| 5,988,934 | A | 11/1999 | Wasserstrom | |
| 6,004,067 | A | 12/1999 | Peppard | |
| 6,059,491 | A | 5/2000 | Striefel et al. | |
| 6,079,904 | A * | 6/2000 | Trisl | 405/107 |
| D431,082 | S | 9/2000 | Jaros | |
| 6,164,870 | A | 12/2000 | Baruh | |
| D455,504 | S | 4/2002 | Foster | |
| 6,413,009 | B1 | 7/2002 | Duckett | |
| 6,588,979 | B1 | 7/2003 | Pasij | |

(Continued)

FOREIGN PATENT DOCUMENTS

CA 2536011 A1 8/2007

*Primary Examiner* — Benjamin Fiorello
(74) *Attorney, Agent, or Firm* — Pearne & Gordon LLP

(57) ABSTRACT

A modular dike or barrier assembly includes straight and curved members that may be interconnected to form a barrier or dike wall surrounding a primary container. The members are hollow and include opposed side walls having integrally formed reinforcing ribs. The side walls extend at an acute angle relative to the base of the barrier to contain and redirect a surge flow directed toward the dike or barrier assembly. The interior surfaces of the side walls are closely spaced at locations spaced from the ribs and tend to abut for added wall reinforcement upon application of wall deflecting loads.

15 Claims, 8 Drawing Sheets

(56) References Cited

U.S. PATENT DOCUMENTS

| | | | |
|---|---|---|---|
| 6,625,925 | B1 | 9/2003 | Foster |
| 6,672,800 | B2 | 1/2004 | Frank |
| 6,695,534 | B2 | 2/2004 | Cain et al. |
| 7,036,676 | B2 | 5/2006 | Christensen |
| 7,144,188 | B1 | 12/2006 | Mallinson et al. |
| 7,168,588 | B2 | 1/2007 | Van Romer |
| 7,234,275 | B1 | 6/2007 | Haggy et al. |
| 7,614,625 | B2 | 11/2009 | Dargue |
| 7,714,825 | B2 | 5/2010 | Yamazaki et al. |
| 7,789,255 | B2 | 9/2010 | Zoppas |
| 2002/0110424 | A1 | 8/2002 | Page |
| 2003/0161688 | A1 | 8/2003 | Frank |
| 2004/0190993 | A1 | 9/2004 | Archer-Simms et al. |
| 2009/0060650 | A1 | 3/2009 | Kulp et al. |
| 2010/0129156 | A1* | 5/2010 | Taylor ..... 405/114 |

* cited by examiner

FIG. 8
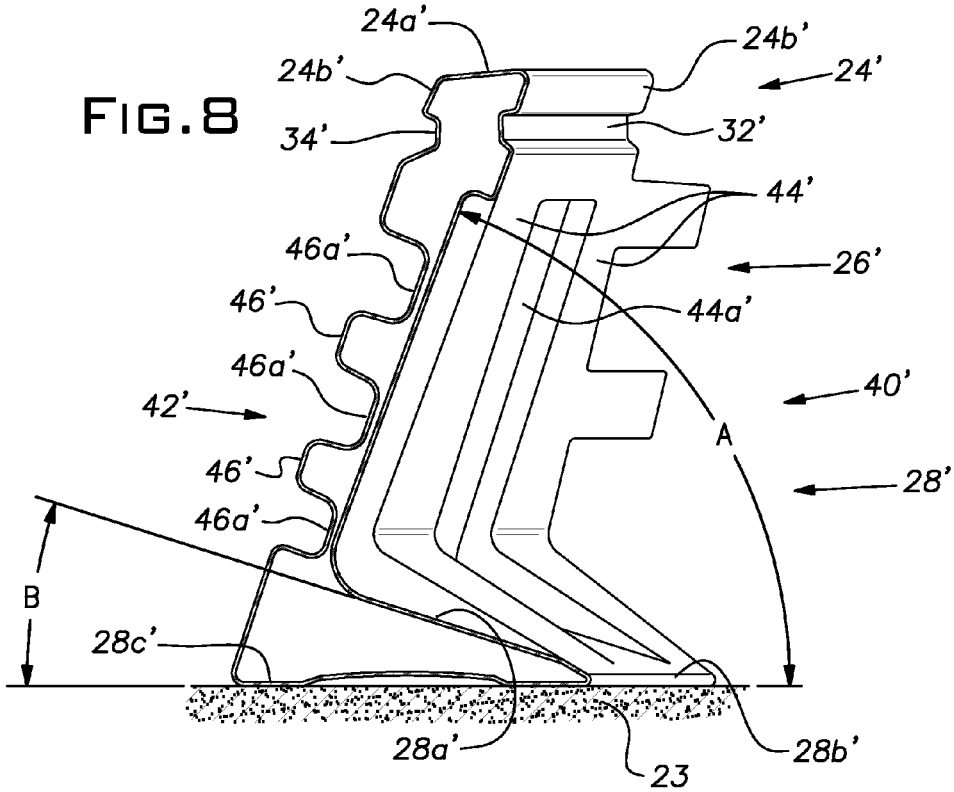
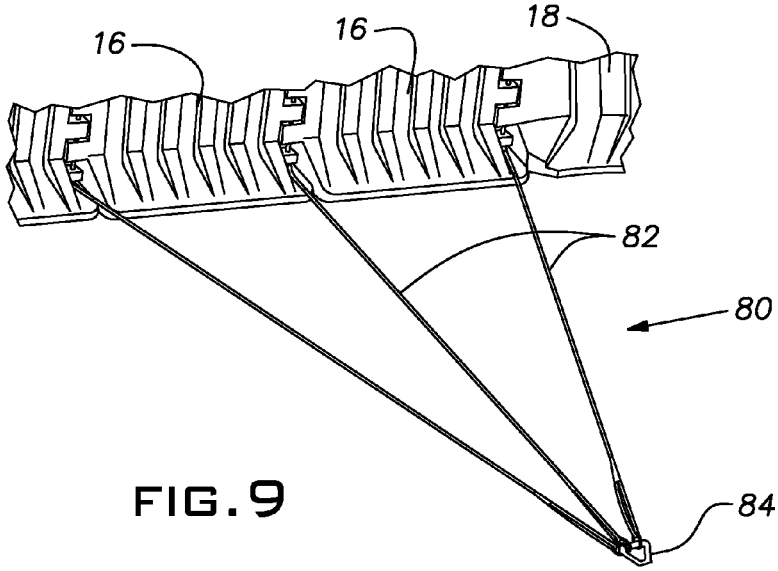
FIG. 9

FIG. 11
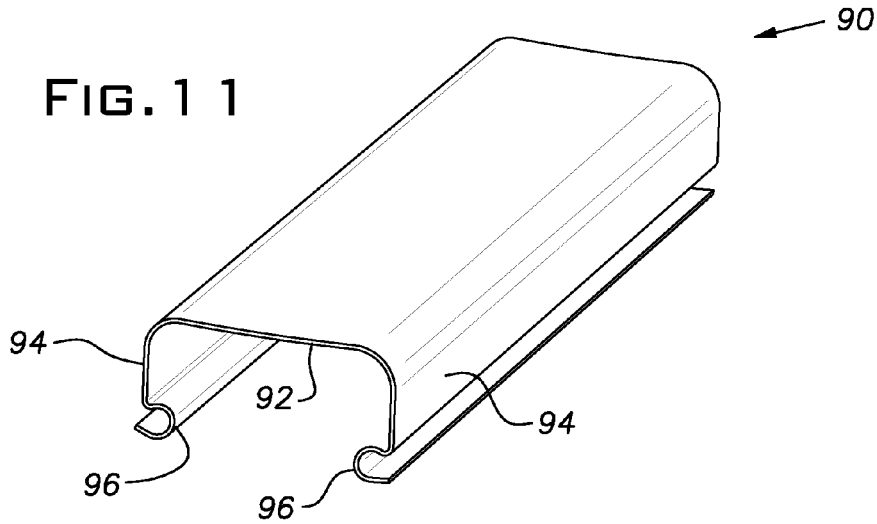
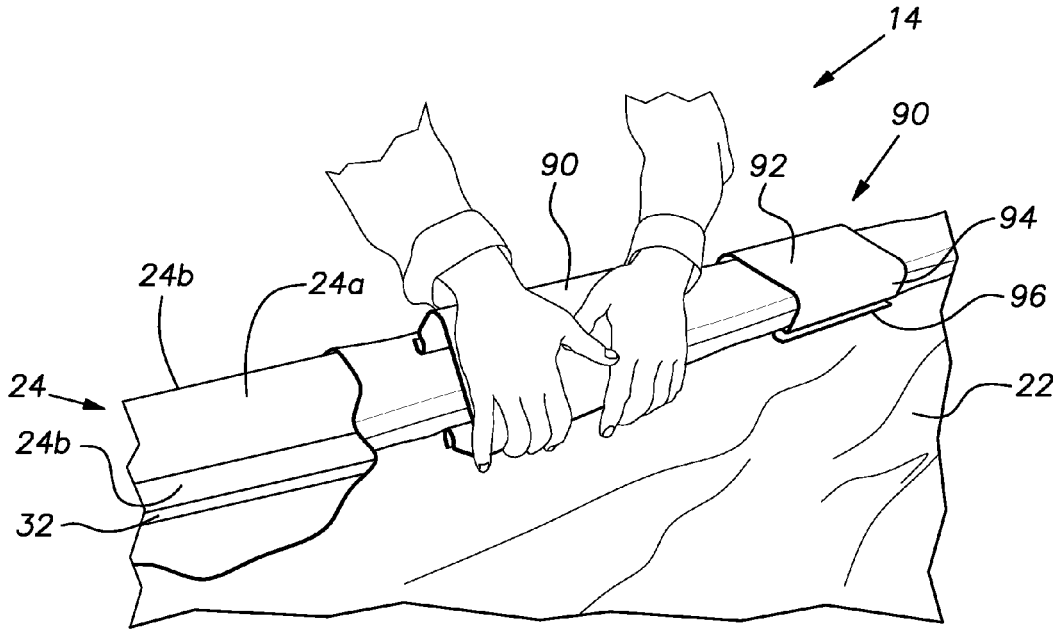
FIG. 12

CONTAINMENT SYSTEM

BACKGROUND OF THE INVENTION

The present invention relates generally to secondary containment systems typically used in connection with hazardous materials or other materials to be isolated from the environment. More particularly, a deployable modular containment system includes straight and curved members that may be interconnected to form a closed barrier or a dike wall surrounding a primary container or otherwise isolating the selected material. The barrier or dike system may be used to restrict liquid flows of other origins such as a flood or other disaster resulting in an unregulated or diverted flow of liquid.

It is known to use secondary containment systems for reducing, if not eliminating, accidental spill of materials being stored or processed. For example, steel drum storage of hazardous materials may require secondary containment under applicable environmental regulations. Military fuel storage may be provided in a primary container surrounded by a secondary containment system.

Prior U.S. Pat. No. 4,765,775, assigned to the assignee of the present application, discloses a modular containment system employing interlocking strut and corner members that are staked to the substratum following assembly. Although portable, the strut and corner members are formed of glass fiber reinforced plastics requiring labor intensive and costly construction and results in a rather heavy and difficult to assemble members. The members are provided with integrally formed posts and receivers that are adhesively secured together. Further, the strut and corner members are generally of trapezoidal cross-section and do not resist surge flows as may occur with a major leak or rupture of the primary container. In fact, the outward inclination of the inner barrier wall tends to facilitate overrun and escape of impacting surge flows.

Prior U.S. Pat. No. 7,714,825, assigned to the assignee of the present application, discloses a modular containment system employing interlocking strut and corner members that are staked to the substratum following assembly. The members are provided with integrally formed female end sockets for receiving male end members. Again, the strut and corner members are formed of glass fiber reinforced plastics and they are generally of trapezoidal cross-section so as to not resist surge flows.

As to be expected, the prior art barrier systems are heavy and raise transportation considerations, especially at remote installation cites and/or tight-fitting tortuous industrial installations wherein the delivery path may be tortuous. In such cases, ease of manipulation for manual transportation and installation is desirable. In all cases, it is desirable that the containment system may be quickly and easily deployed and assembled. This is particularly true in the case of military applications wherein assembly, disassembly and transportation of the system may be provided at different locations by different personnel. Accordingly, it is important that the system components be limited in number and readily assembled to provide a sturdy construction.

SUMMARY OF THE INVENTION

In accordance with the invention, a modular containment system is provided with a limited number of easily assembled straight and corner or curved members. The members are formed of a moldable plastic material. Consequently, the fabrication cost of the members is significantly reduced as compared with prior art barrier systems.

As indicated, the members are molded of plastic material, and preferably, the members are rotationally molded and have a generally hollow construction. The members may be formed of any suitably rigid plastic material such as low density polyethylene. Recycled materials may be used to form the members.

The members include a top wall extending to opposed side walls that are joined to a base. The length of the member is considered to extend in a longitudinal direction that is generally parallel to the supporting substratum or ground. The members are closed and include opposed longitudinal end walls. Connector ends are provided at the longitudinal ends of the members so that they may be joined end-to-end to form the dike system or barrier.

The members are constructed to provide at least one inclined side wall adjacent the contained material. The inclined side wall slopes toward the contained material or into the path of a likely flow of material to be contained. For example, the inclined side wall may extend at an enclosed acute angle relative to the base of the barrier.

The inclined angle of the side wall tends to contain and redirect a liquid flow directed toward or impinged upon the member. The inclined angle of the side wall may be up to less than about 90° relative to the base of the barrier and otherwise sufficient to tend to contain and redirect a liquid flow impinging upon the member. In preferred arrangements, the inclined angle is greater than from about 30° to less than about 80°, and more preferably, from about 60° to less than about 80°.

In preferred arrangements, the member is hollow and both side walls extend at the same inclined angle relative to the base. The rigidity of the members is increased by forming separate reinforcing ribs in the side wall. In the illustrated embodiment, ribs are provided in each of the side walls and extend along major area portions of the side walls.

Preferably, the ribs extend in intersecting angular directions so as to increase rigidity and resist buckling in corresponding directions. Thus, the ribs may be generally disposed in a vertical direction in one side wall and a horizontal direction in the other side wall so as to resist flexure of the member in both vertical and horizontal directions.

The ribs have a height equal to about one-half of the overall wall thickness of the member as defined by the spaced side walls. Accordingly, the interior surfaces of the opposed side walls are closely spaced and substantially abut at locations between the ribs. The close spacing of the interior surfaces of the side walls results in engagement upon loading and flexure of the member whereby the side walls tend to reinforce each other.

An impermeable liner is placed over the joined members to contain liquid. An edge of the liner is secured to the member by a clip that resiliently engages the top wall of the member to trap the liner edge between the clip and the top wall.

BRIEF DESCRIPTION OF THE DRAWINGS

FIG. 8 is a sectional view taken along the line 8-8 in FIG. 6;

FIG. 9 is a fragmentary isometric view of three connected members fitted with a spider cable in preparation for further cable installation;

FIG. 11 is an isometric view showing a resilient clip for securing the liner to the dike assembly;

FIG. 12 is a fragmentary isometric view showing the liner being secured to a member forming the dike system using the clip of FIG. 11.

DETAILED DESCRIPTION OF THE INVENTION

Figure 1:
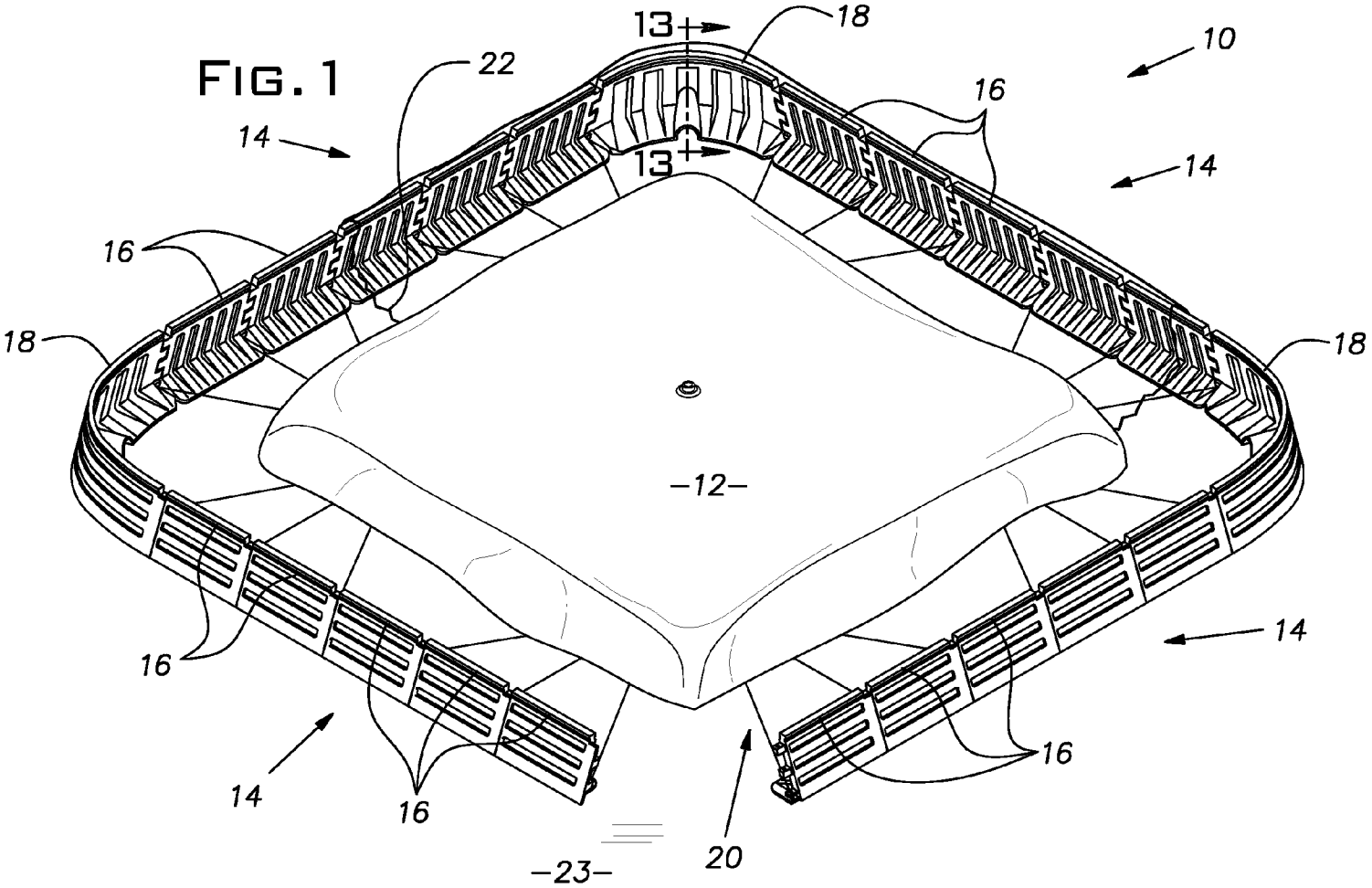
FIG. 1 is an isometric view of a closed dike assembly having straight and curved members in accordance with the invention surrounding a primary container and having parts broken away or omitted for purposes of illustration.

A closed barrier or dike assembly 10 surrounding a primary container 12 is shown in FIG. 1. The primary container 12 is a flexible bladder construction that may contain a fuel to be isolated from the environment in case of container failure or as required by environmental regulations. The primary container may comprise a storage tank (not shown) for industrial liquid supplies such as lubricants, solvents, reactants or any other liquid requiring secondary containment.

The dike assembly 10 has a generally rectangular configuration with rounded corners provided by opposed dike walls 14 formed by interlocked straight members 16 extending between and interlocked with corner members 18. A cable web 20 is provided for securing the members 16 and 18 together as further explained below.

For purposes of liquid containment, a liquid impermeable barrier film or liner 22 is disposed between the primary container 12 and the web 20, along the substratum 23 and over the dike walls 14. The liner 22 may be secured in place by connection to the dike walls as explained in detail below.

The liner 22 is preferably a flexible flat sheet that may be conformed to the interior shape of the dike assembly including the surfaces of the straight and corner members as well as the contour of the substratum 23. The liner 22 may be formed of a suitable plastic material such as polyamide, polyester or polyurethane with or without reinforcement. For clarity of illustration, the liner 22 is transparent and has been broken away so that only the top left corner of the liner is shown in FIG. 1. Of course, the liner 22 may be opaque and/or comprise a fabric/plastic laminate.

Figure 2:
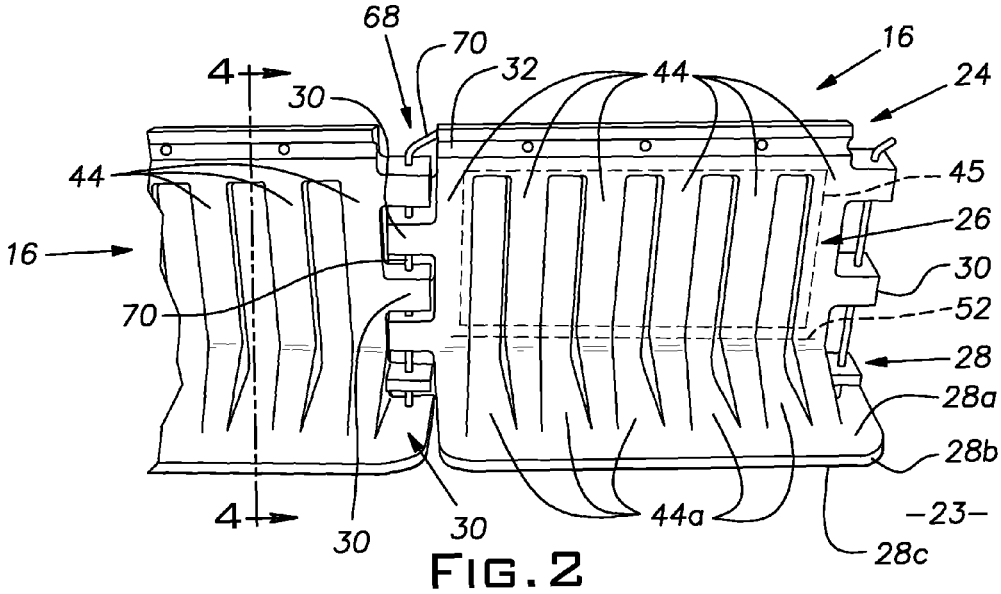
FIG. 2 is an elevational view of connected straight members, as seen from the proximal side of the dike assembly, with parts broken away and omitted for convenience of illustration.
Figure 3:
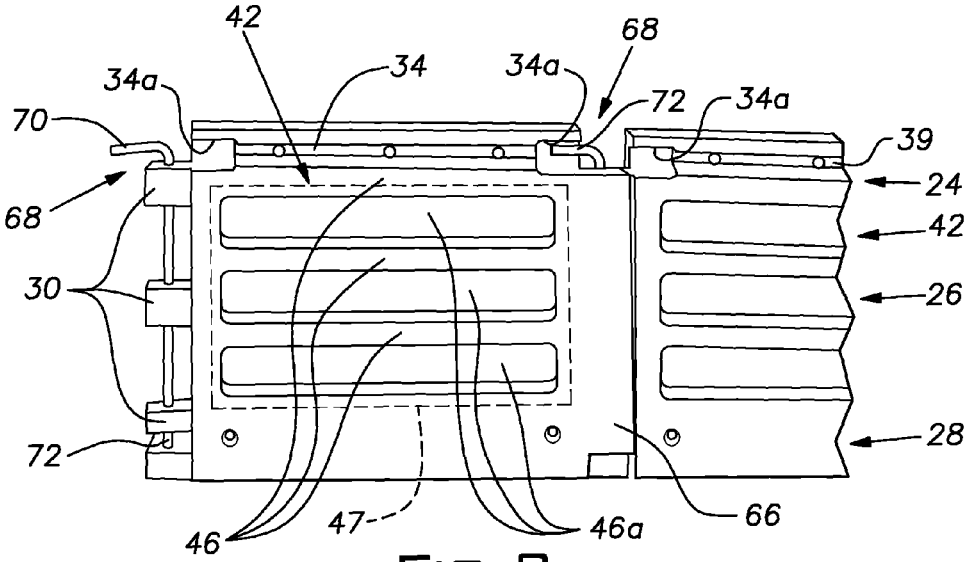
FIG. 3 is an elevational view similar to FIG. 2 as seen from the distal side of the dike assembly.
Figure 4:
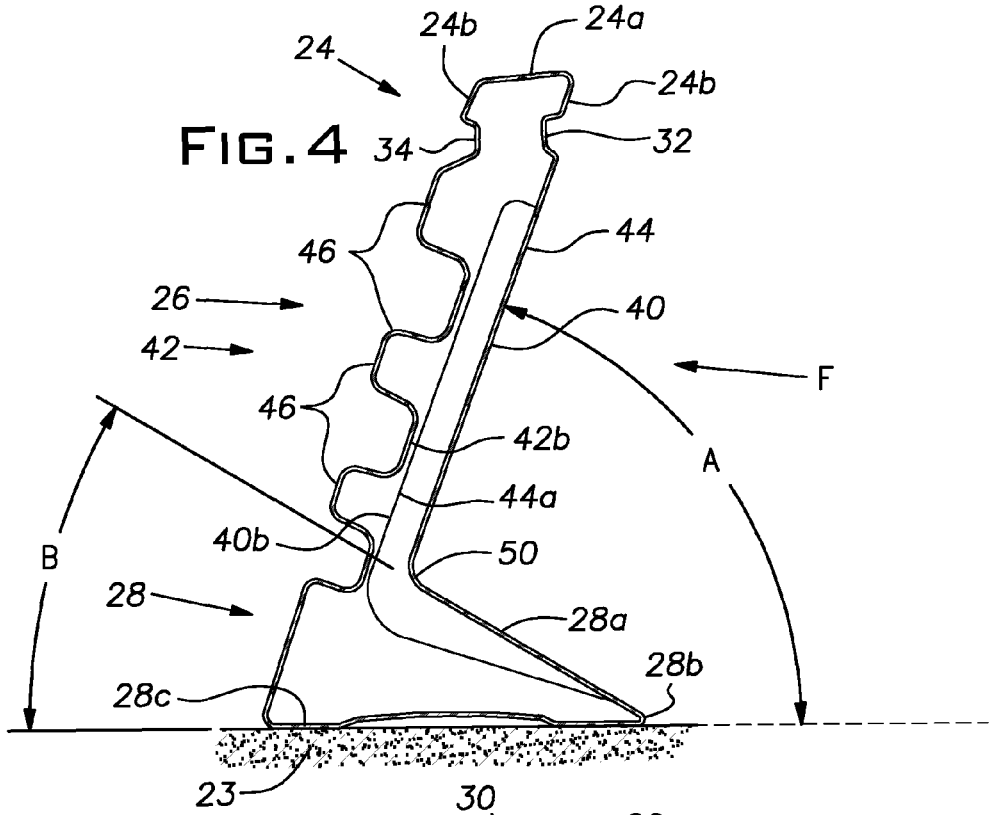
FIG. 4 is a sectional view taken along the line 4-4 in FIG. 2.

Referring to FIGS. 2 through 4, the straight member 16 extends in a substantially straight longitudinal or horizontal direction to provide the member with a length equal to about 4 feet. The member 16 has a vertical height equal to about 3 feet. The length and height dimensions are not critical.

The member 16 has an inclined L-shape including a top portion 24, a central wall portion 26, an enlarged base portion 28 for engaging the substratum 23, and longitudinal end portions 30. The member 16 is formed by rotational molding and each of the portions 24-30 is formed as a continuous plastic wall of the molded part. The portions 24-30 are described below.

The top portion 24 has a general rectangular cross-section (FIG. 4) including a top wall 24*a* connected to opposed walls 24*b* that extend respectively to a proximal recess 32 and a distal recess 34 located on opposite sides of the member 16. For convenience herein, the side of the dike or barrier system adjacent the contained material is referred to as the proximal side and the other side of the dike or barrier system is referred to the distal side.

The central wall portion 26 is formed by a proximal side wall 40 and a distal side wall 42. The side wall 40 includes a plurality of reinforcing ribs 44 extending in a generally vertical or rib direction along a major area portion of the side wall 40. The ribs 44 are spaced by recesses 44*a* so that the side wall 40 has a corrugated shape as viewed in cross section in FIG. 4. Each of the ribs 44 has a generally uniform cross-section extending in the rib direction in the side wall. The specific dimensions and spacing of the ribs 44 may be varied in order to provide a suitable reinforcing strength. As illustrated, the ribs 44 and the recesses 44*a* each have a width of about 4" and a height or depth of about 1.5". As shown, the ribs 44 and recesses 44*a* extend into the base portion 28 as further discussed below.

The distal side wall 42 is provided with a plurality of reinforcing ribs 46 extending in a generally horizontal direction along a major area portion of the side wall 42 generally corresponding with the area enclosed by the dashed line 45 (FIG. 2). As used herein, major area portion means more than about 50% of the total wall area. Herein, the area enclosed by the dashed line 45 is about 76% of the total area of the side wall 42.

The ribs 46 are spaced by recesses 46*a* so that the side wall 46 also has a corrugated profile when viewed in cross-section. Again, the specific dimensions and spacing of the ribs 46 may be varied in order to provide a suitable reinforcing strength. As illustrated, the ribs 46 and recesses 46*a* each have a width of about 4", and a height or depth of about 3" along a major area portion of the side wall 42 generally corresponding with the area enclosed by the dashed line 47 (FIG. 3).

In this instance, the major area portion enclosed by the dashed line 47 is equal to about 65% of the total area of the wall extending below the recess 34 to a height generally corresponding with that of the angular wall joint 50 and between the ends 30.

As best shown in FIG. 4, adjacent interior surfaces 40*b* and 42*b* of the recesses 40*a* and 42*a* in the side walls 40, 42 are closely spaced and substantially abut adjacent the recesses 44*a* and 46*a*. These adjacent surfaces 40*b* and 42*b* are spaced apart in accordance with the rotational molding process to allow for resin flow between the mold portions and the interior surfaces as they are formed. In the illustrated embodiment, the adjacent interior surfaces of the recesses are spaced apart a distance of about 0.25".

The spacing of the surfaces 40*b* and 42*b* is sized to provide reinforcing engagement of the surfaces upon flexure of the walls 40 and 42. In this manner, the walls 40, 42 and member 16 are reinforced in response to flexure loading as upon surge loading by fluid impact.

Each of the side walls 40 and 42 has a wall thick of from about 0.13" to about 0.18". The overall thickness of the central wall portion 26 as measured by the exterior surface extremities of the side walls 40 and 42 is about 5.25".

The base portion 28 has a generally triangular cross-section including an inclined base wall 28*a*, a peripheral base wall 28*b* and a lower base support wall 28*c* arranged to engage the substratum 23. The base portion 28 joins the lower portion of the distal side wall 42. The inclined base wall 28*a* joins the side wall 40 along an integrally formed angular wall joint 50 generally indicated by the dashed line 52. In the same manner, the side wall 40 and the inclined base wall 28*a* are integrally formed as part of the rotationally molded one-piece straight member 16.

As illustrated, lower portions of the ribs 44 and recesses 44*a* extend to form the inclined base wall 28*b*. In turn, the base wall 28 extends to and joins the peripheral base wall 28*b* and the lower base wall 28*c*. The lower portions of the ribs and recesses reinforce the inclined base wall 28*a*.

With particular reference to FIG. 4, the proximal side wall 40 forms an enclosed acute angle "A" relative to the bottom base wall 28*c*. The inclined angle of the side wall tends to contain and redirect in a reverse direction liquid flowing against the wall 40 and member 16. The inclined angle "A" is 70° in the illustrated embodiment, but may range from about 60° to about 80° as discussed above. If the angle is too small, the wall 40 and member 16 may be overly stressed and structurally fail due to loads imposed an impinging liquid flow. On the other hand, if the angle is too large, the liquid will over flow the wall.

The inclined base wall 28*a* forms an enclosed acute base angle "B" relative to the bottom base wall 28*c*. The base angle "B" may be up to about 45° and is 30° in the illustrated embodiment. The inclined base wall 28*a* reinforces the connection between the central wall portion 26 and the base portion 28.

The stability of the member 16 is further enhanced by maintaining the projection of top portion and the center of mass of the central wall portion 26 within a foot-print corresponding with the base portion 28. This geometry inhibits the tendency of the member 16 rotate upon impingement of a surge flow. The base wall 28*c* has thickness of about 22" as measured between its proximal and distal extremities.

The longitudinal end portions 30 include longitudinal end walls 60 and longitudinally projecting connector teeth 62. The connector teeth 62 are arranged at different heights at opposite ends of the member 16 for engagement with corresponding connector teeth on an adjacent member 16 or 18.

It should be appreciated that the surge liquid impacting with and/or resting upon the inclined wall 28*a* further contributes to the stability of the member 16. That is, weight of such water provides a downward force component pressing the base portion 28 against the substratum 23.

Figure 5:
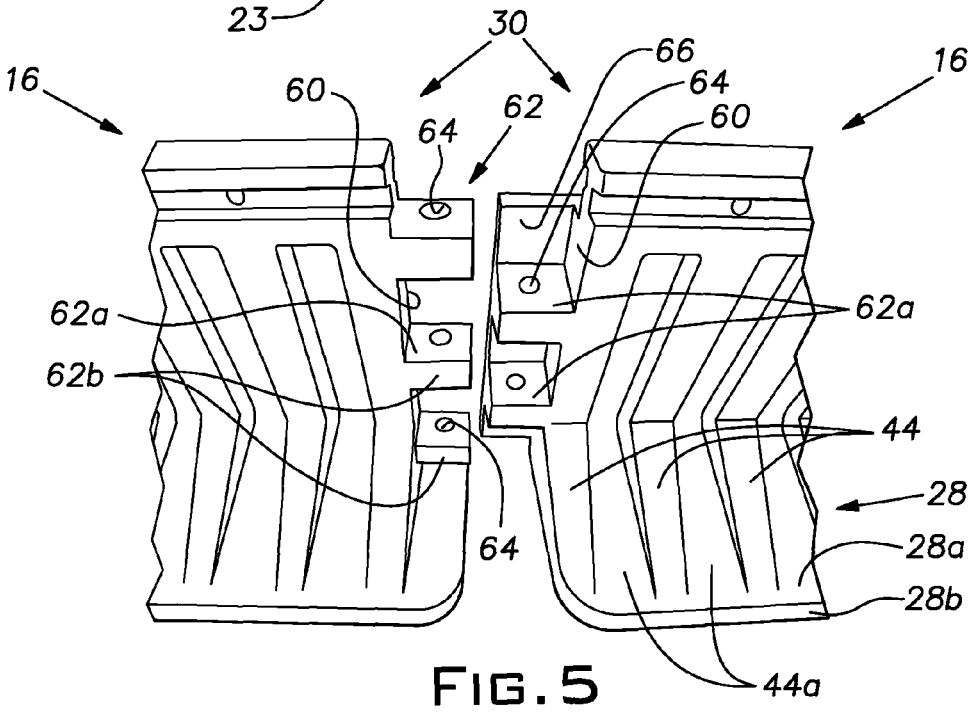
FIG. 5 is an isometric view of the connector ends of adjacent members spaced apart for illustration purposes.

Referring to FIG. 5, members 16 are disengaged and slightly spaced to better illustrate the teeth 62 and their staggered heights on opposite longitudinal ends of the members. The connector teeth 62 are integrally formed with the end walls 60 and members 16. Each connector tooth 62 has a boxlike shape of generally rectangular cross-section. Each connector tooth 62 has generally flat upper and lower walls 62*a* connected by flat side walls 62*b*. A tunnel opening 64 is formed by extension of the walls 62*a* through each tooth 62. The tunnel openings 64 are aligned in a vertical direction for receipt of a locking pin 66 as described more fully below.

As best shown in FIGS. 3 and 5, a connector shroud wall 66 extends from the distal side wall 42 to cover the teeth 62. In the illustrated embodiment, the shroud wall 66 integrally extends from the distal right end of the side wall 42. The shroud wall 66 is hollow. The shroud wall 66 provides additional support for the teeth 62 and increased rigidity at the longitudinal ends 30 to better maintain the alignment of the teeth 62.

Referring to FIGS. 2 and 3, the locking pin 68 is a metallic tubular member having an L-shape including a straight leg 70 and an angularly offset handle lock 72. The leg 70 extends through the tunnel openings 64 in the aligned teeth 62 and secures adjacent members 16 and/or 18 together. The distal recess 34 has enlarged ends 34*a* for receipt of the handle lock 72. More particularly, the handle lock 72 is rotated into the adjacent distal recess 34*a* with a friction fit to fix the pin 68 against vertical movement.

Figure 6:
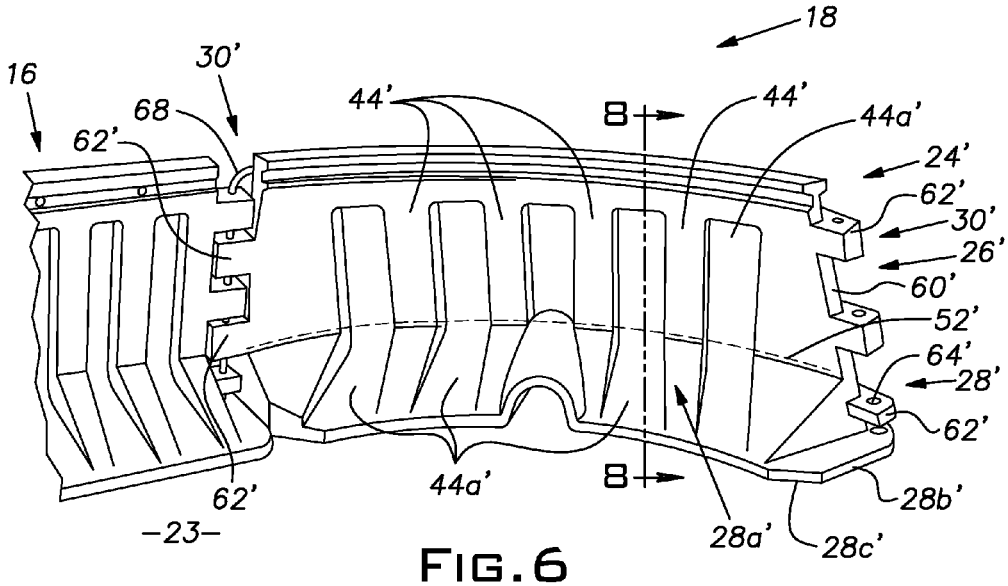
FIG. 6 is an elevational view showing a straight member connected to a curved member of FIG. 4 as viewed from the proximal side of the dike.
Figure 7:
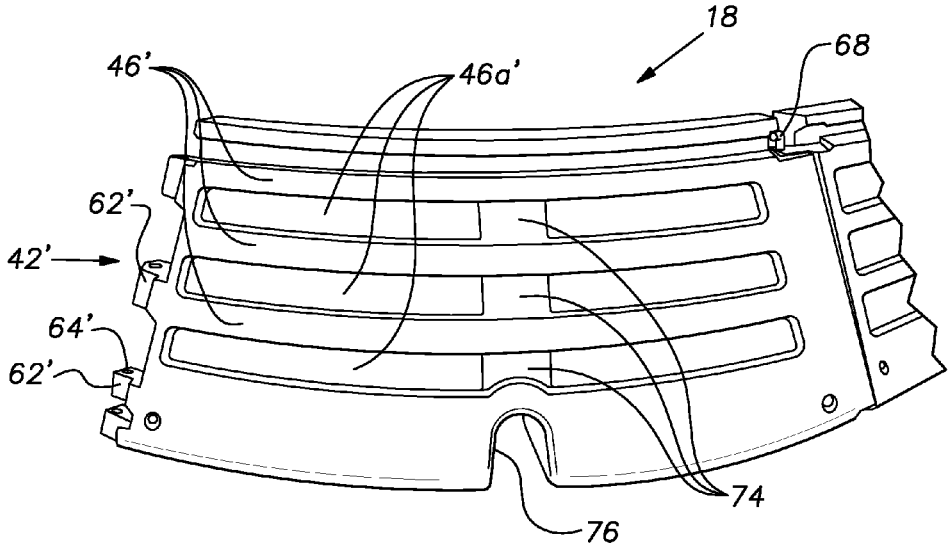
FIG. 7 is an elevational view similar to FIG. 6 as seen from the distal side of the dike assembly.

Referring to FIGS. 6, 7 and 8, the corner member 18 connected to an adjacent straight member 16 is shown. The corner member 18 extends in an arcuate or curved longitudinal direction and is otherwise configured in the same manner as the member 16. Accordingly, like reference numerals are used for corresponding elements with the addition of a prime designation.

The member 18 also has an inclined L-shape including a top portion 24', a central wall portion 26', an enlarged base portion 28' for engaging the substratum 23, and longitudinal end portions 30'. The member 18 is also formed by rotational molding and each of the portions 24'-30' is formed as a continuous plastic wall of the molded part.

The top portion 24' corresponds with the top portion 24 but for the curved longitudinal shape. Accordingly, a top wall 24*a'* is connected to opposed walls 24*b'* that extend respectively to a proximal recess 32' and a distal recess 34' located on opposite sides of the member 18.

The central wall portion 26' is formed by a [concave] proximal side wall 40' and a [convex] distal side wall 42'. The side wall 40' includes a plurality of reinforcing ribs 44' extending in a generally vertical direction along a major area portion of the side wall 40'. The ribs 44' are spaced by recesses 44*a'* so that the side wall 40' has a corrugated shape as viewed in cross section in FIG. 8. The specific dimensions and spacing of the ribs 44' may be varied in order to provide a suitable reinforcing strength. As illustrated, the ribs 44' have a width of about 8" and the recesses 44*a'* each have a width of about 12" and a height or depth of about 2.5".

The distal side wall 42' is provided with a plurality of reinforcing ribs 46' extending in a generally horizontal direction along a major area portion of the side wall 42'. The ribs 46' are spaced by recesses 46*a'* so that the side wall 46' also has a corrugated profile when viewed in cross-section. Again, the specific dimensions and spacing of the ribs 46' may be varied in order to provide a suitable reinforcing strength. As illustrated, the ribs 46' and recesses 46*a'* each have a width of about 4", and a height or depth of about 3".

In the member 18, the recesses 46*a'* are interrupted by a central located vertically extending rib 74. The rib 74 is positioned above a tunnel drain opening 76 extending through the base portion 28' of the member 18. That is, the inclined base wall 28*a'* and the distal side wall 42' extend through the base portion 28' to form the drain opening 76.

As best shown in FIG. 8, the adjacent interior surfaces of the recesses 44*a'* and 46*a'* are closely spaced and substantially abut in the same manner as the described above with respect to the interior surfaces of the recesses 44*a* and 46*a*. Similarly, each of the side walls 40' and 42' has a wall thickness of about 0.13" to about 0.18". The overall thickness of the central wall portion 26' as measured by the exterior surface extremities of the side walls 40' and 42' is about 5.25".

As described above, the base portion 28' has a generally triangular cross-section including an inclined base wall 28*a'*, a peripheral base wall 28*b'* and a lower base support wall 28*c'* arranged to engage the substratum 23. The base portion 28' joins the lower portion of the distal side wall 42'. The inclined base wall 28*a'* joins the side wall 40' along an integrally formed angular wall joint 50' generally indicated by the dashed line 52'. Similarly, the side wall 40' and the inclined base wall 28*a'* are integrally formed as part of the rotationally molded one-piece straight member 18.

As illustrated, lower portions of the ribs 44 and recesses 44*a* extend to form the inclined base wall 28*a*'. In turn, the base wall 28*a*' extends to and joins the peripheral base wall 28*b*' and the lower base wall 28*c*'. The lower portions of the ribs and recesses reinforce the inclined base wall 28*a*'.

With particular reference to FIG. 8, the proximal side wall 40' forms an enclosed acute angle "A" relative to the bottom base wall 28*c*' and the inclined base wall 28*a*' forms an enclosed acute base angle "B" relative to the bottom base wall 28*c*' in the same manner as described above with respect to the member 16 in order to obtain similar containment of liquid flow.

The stability of the member 18 is enhanced in the same manner as in the case of the straight member 16 by maintaining the projection of top portion and the center of mass of the central wall portion 26' within the foot print of the base portion 28'. The lower base wall 28*c*' in contact with the substratum 23 is provided with a gross wall radial dimension of about 22" as measured from its proximal to its distal extremities along a radius of the curve of the member 18.

The longitudinal end portions 30' include longitudinal end walls 60' and longitudinally projecting connector teeth 62'. As described above, the connector teeth 62' are arranged at different heights at opposite ends of the member 18 for engagement with corresponding connector teeth on an adjacent member 16 or 18.

The connector teeth 62' are integrally formed with the end walls 60' and member 18 as described above with respect to the member 16. Further, the teeth 62' are shaped and constructed in the same manner as the teeth 62 and include aligned tunnel openings 64' for receipt of a locking pin 68.

Figure 10:
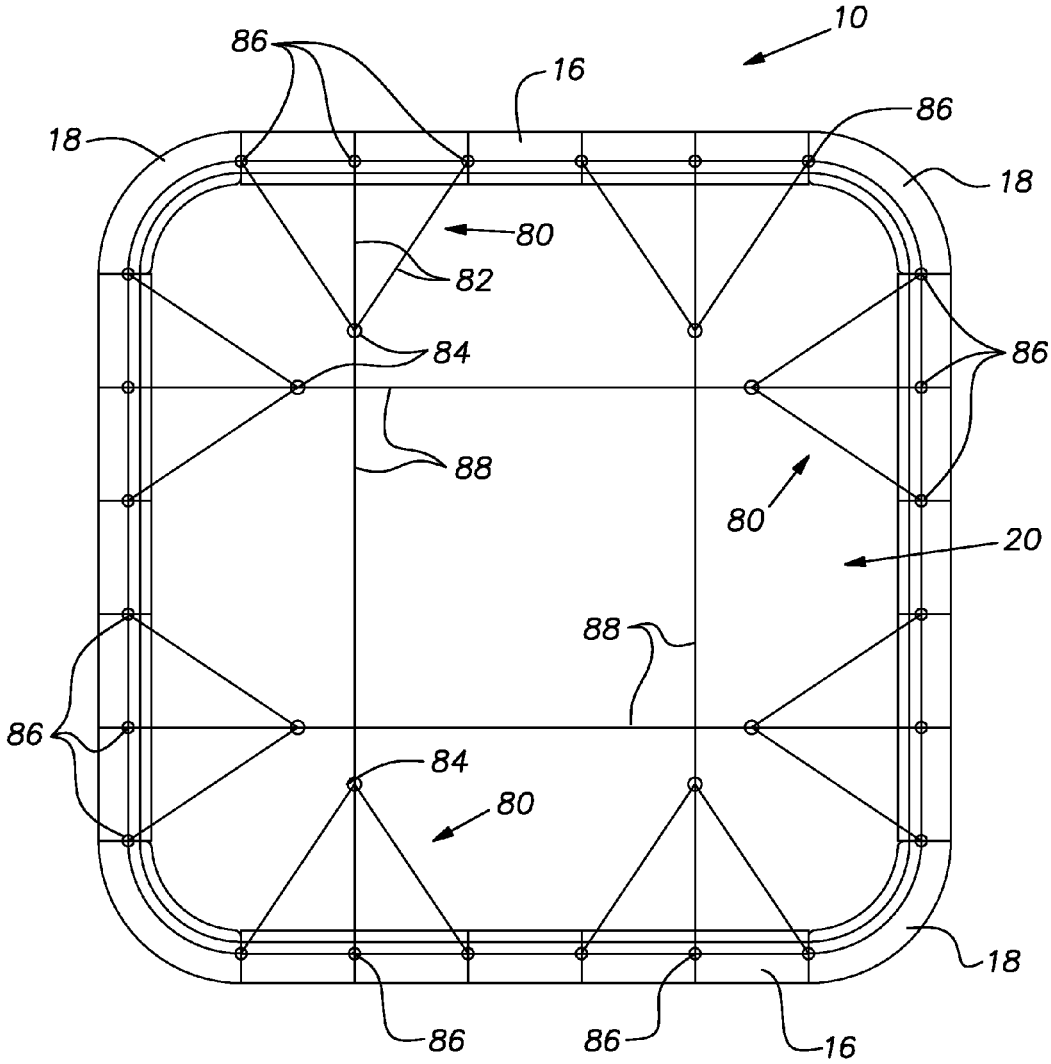
FIG. 10 is a schematic top view showing the dike assembly of FIG. 1 having its members secured together by a cable web including spider cable arrays and straight cables.
Figure 13:
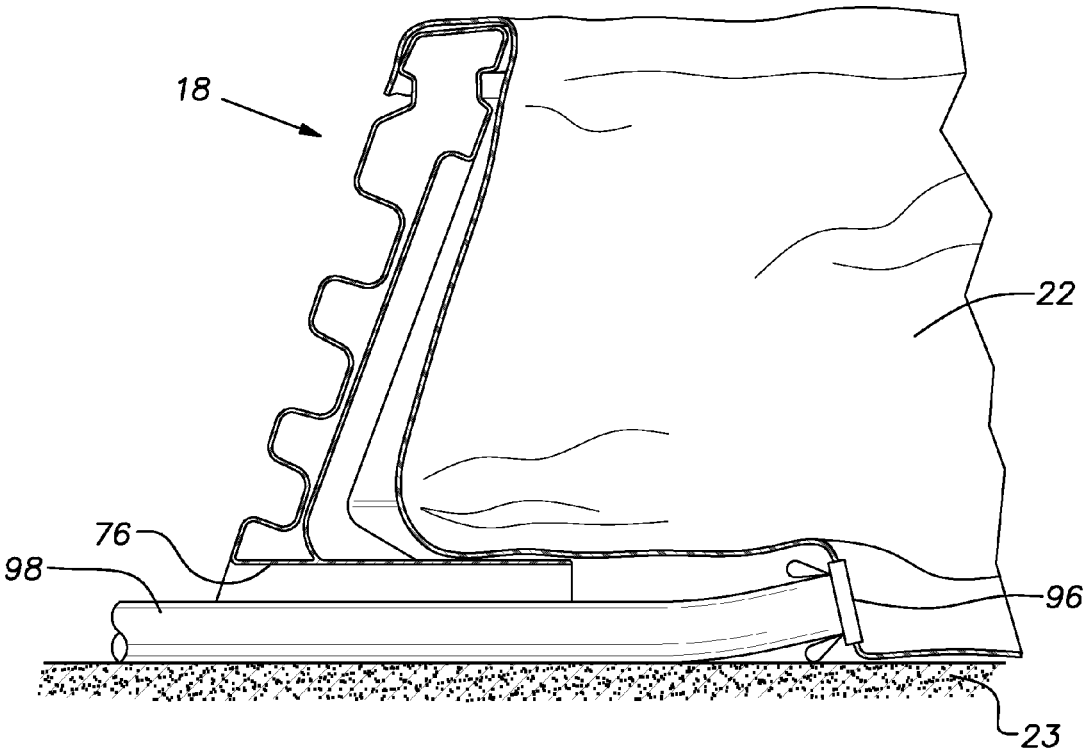
FIG. 13 is a schematic sectional view taken along the line 13—in FIG. 1 showing a closable drain valve and a duct for draining the liner.

As shown in FIGS. 1, 9 and 10, the assembled barrier or dike 10 may optionally be reinforced by the cable web 20. To that, the web 20 includes spider webs 80 formed of three spider cables 82 having cable ends joined to closed connector member 84. The opposite ends of the spider cables are connected to associated triangular connectors 86 as schematically shown in FIG. 10. The members 86 are joined to associated members 16 or 18 by passing the end of the leg 68 through the member 86 to trap it between one of the teeth 62 and the base portion 28 or 28' of the member.

Referring to FIG. 10, straight cables 88 may be used to join the spider webs 80 by attachment to opposed connector members 84. As also shown, each end of the straight cable 88 may be fitted with a connector member 86 and connected to opposed locking pins 68.

Referring to FIG. 11, a resilient clip 90 for mounting an edge of the liner 22 to the dike wall 14 is shown. The clip 22 has a channel or U-shape including a central bight 92 connecting opposed channel legs 94. Each of the channel legs 94 terminates at a reverse bend 96. The clip 90 is symmetrical about its longitudinal axis and it may be mounted with either leg adjacent the proximal wall 40 or the distal wall 42. As described more fully below, the clip 90 is sized to fit over the top portion 24 or 24' of the member 16 or 18 with the reverse bends 96 engaged within the recesses 32 and 34. The clip 90 has a longitudinal length of about 1 foot, but its length is not critical, a sufficient number of clips may be used to securely mount the liner to the dike walls 14. To that end, the liner 22 is manually positioned within the dike space and draped over the top portions 24 and 24' of the members 16 and 18, and secured to the dike walls 14 using a plurality of spaced clips.

The clip 90 is formed of glass fiber reinforced resin such as polyethylene, polypropylene, polyvinyl chloride, polystyrene and polyester as well as recycled plastics and/or inert fillers. The clip 90 has a limited range of elastic deformability or flexibility for resiliently engaging the top portion 24 or 241. More particularly, the clip 90 is sized to receive the top portion 24 or 241 in a tight resilient fit with the edge of the liner 22 trapped between the clip and the top portion. To that end, the bends 96 are spaced apart in the normal state a distance about equal to the thickness spacing between the recesses 32 and 34 to allow the resilient capture of the liner 22 and the frictional fixing of the same to the top portion 24 or 24'.

Referring to FIG. 12, the edge of the liner 22 is positioned over the top portion 24 and mounting of the clip 90 is illustrated. The clip may be positioned above the liner 22 and the top portion 24 with one of the bends 96 positioned in the proximal recess 32 or 32'. The clip is then pulled rearward and downward over the opposite side wall 24*a* or 24*a*' to position the other bend 96 into the distal recess 34 or 34'. During this process, the separation of the bends 96 causes the bight 92 to be flexed inwardly to tightly bias the liner 22 against the top wall 24*a* of the top portion 24.

With particular reference to FIG. 1, the Dike assembly 10 is provided with a 32'×32' generally square shape with rounded corners and a 4' height. The bladder 12 also has a generally square shape and a size of 24'×24'×4'. The filled bladder holds about 10,000 gallons of liquid. The bladder 12 is centrally positioned within the dike assembly 10 so as to about a 4' space between the filled bladder and the adjacent dike wall 14. The dike assembly 10 and bladder 12 were positioned on substantially horizontal and level substratum 23 or ground area.

For purposes of evaluating the surge flow resistance of the dike assembly 10, the bladder 12 was filled with about 10,000 gallons of water. The bladder 12 was formed of a plastic material reinforced with a woven fabric. Puncture of a top edge of the bladder with a sharp knife resulted in an immediate tear or rupture of the fabric forming the bladder about 10 to 20 inches long, and a surge flow of the water through the tear and against the adjacent proximal side of the dike assembly occurred with the latter being substantially emptied in less than a minute.

The initial surge flow of water impinged on the dike wall and the flow was substantially redirected and contained within the dike assembly. A limited amount of water, estimated to be a few hundred gallons, flowed over the dike wall, and the remaining water was contained. It is estimated that full containment would be achieved with the addition of one additional straight member 16 to each dike wall for this size bladder. In contrast, prior art dike assemblies having vertical or outwardly sloped walls are estimated to result in thousands of gallons of liquid flow over wall in response to such a surge flow.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A liquid surge resistant modular barrier comprising:

a plurality of members extending in a longitudinal direction to longitudinal ends that are connected to form said barrier, each member including a top portion connected to a central wall portion having first and second opposed side walls that extend to a base portion having a base wall for engagement with a support surface, and at least one of said side walls extending at an acute angle relative to the base wall toward the liquid to be contained to tend to redirect a liquid flow toward the member, wherein said members include straight and curved members, each of said members is a hollow closed element formed of a continuous layer of plastic, said members include elongate reinforcing ribs in said side walls, said reinforcing ribs extend in first and second directions that are angularly offset, said reinforcing ribs extend in said first direction in said first side wall and extend in said second direction in said second side wall, and said first and second side walls have adjacent interior wall surfaces at locations between opposed reinforcing ribs that engage upon deflection of said side walls in said first or second direction to reinforce said side walls and said member.

2. The barrier of claim 1, wherein said first and second side walls respectively have first and second major areas, said reinforcing ribs extend along substantially the entire extend of said first and second major areas.

3. A liquid surge resistant modular barrier comprising;

a plurality of members extending in a longitudinal direction to longitudinal ends that are connected to form said barrier, each member including a top portion connected to a central wall portion having first and second opposed side walls that extend to a base portion having a base wall for engagement with a support surface, and each of said first and second side walls extending in an acute angle relative to said base wall toward the liquid to be contained, each of said side walls including reinforcing ribs, said reinforcing ribs extending in said side walls in a horizontal direction in one side wall and a vertical direction in the other side wall to resist buckling or flexure of said member in a vertical or horizontal direction.

4. The barrier of claim 3, wherein said members include straight and curved members, and each of said members is a hollow closed element formed of a continuous layer of plastic.

5. The barrier of claim 3, wherein said base portion has a substantially triangular cross-sectional shape including an inclined base wall extending upwardly from said base wall to join one of said side walls, said inclined base wall extending to said one of said side walls at an angle of up to about 60° relative to said base wall.

6. A liquid surge resistant modular barrier comprising;

a plurality of members extending in a longitudinal direction to longitudinal ends that are connected to form said barrier, each member including a top portion connected to a central wall portion having first and second opposed side walls that extend to a base portion having a base wall for engagement with a support surface, and each of said first and second side walls extending in an acute angle relative to said base wall toward the liquid to be contained, each of said side walls including reinforcing ribs, said reinforcing ribs extending in said side walls in rib directions that are angularly offset to resist buckling or flexure of said member in a vertical or horizontal direction, wherein said first and second side walls have adjacent interior wall surfaces at locations between opposed reinforcing ribs that engage upon flexure of said side walls to reinforce said member.

7. The barrier of claim 6, wherein each of said ribs has a generally uniform cross-section extending in said rib direction, said opposed side walls respectively have first and second major areas, and said reinforcing ribs extend in said rib directions along substantially the entire extend of said major areas.

8. The barrier of claim 7, wherein said base portion has a substantially triangular cross-sectional shape including an inclined base wall extending upwardly from said base wall to join one of said side walls.

9. The barrier of claim 8, wherein said inclined base wall extends to said one of said side walls at an angle of up to about 60° relative to said base wall.

10. The barrier of claim 9, wherein said reinforcing ribs in said one of said side walls extend in said inclined base wall.

11. The barrier of claim 10, further including a liquid impermeable liner having a liner edge disposed over said members, a resilient clip securing said liner edge to said barrier, wherein said top portion has a top wall connecting downwardly depending side walls that respectively extend to a longitudinal top recess, said resilient clip engaged with said top portion to secure a liner edge to said barrier, said clip having an elongated U-shape with a flat bight extending to opposed legs for engagement with said longitudinal top recesses to trap the liner edge between the clip and the top portion of said member.

12. The barrier of claim 11, wherein said longitudinal ends include connector teeth having through openings that vertically align upon engagement of connector teeth of adjacent members, and a locking pin having a straight portion and an offset handle-lock, said locking pin straight portion being received in said aligned openings of engaged connector teeth and being rotatable to dispose said handle-lock within an adjacent longitudinal top recess.

13. A liquid surge resistant modular barrier comprising:

a plurality of members extending in a longitudinal direction to longitudinal ends that are connected to form said barrier with a closed configuration surrounding liquid to be contained, each member including a top portion connected to a central wall portion having first and second opposed side walls that extend to a base portion having a base wall for engagement with a support surface, and each of said first and second side walls extending in an acute angle relative to said base wall toward the liquid to be contained, each of said side walls including reinforcing ribs, said reinforcing ribs extending in said side walls in rib directions that are angularly offset to resist buckling or flexure of said member in a vertical or horizontal direction, wherein said base portion has a substantially triangular cross-sectional shape including an inclined base wall extending upwardly from said base wall to join one of said side walls, said inclined base wall extending to said one of said side walls at an angle of up to about 60° relative to said base wall, and said first and second side walls have adjacent interior wall surfaces at locations between opposed reinforcing ribs that engage upon flexure of said side walls to reinforce said member.

14. The barrier of claim 13, wherein further including a liquid impermeable liner having a liner edge disposed over said members, a resilient clip securing said liner edge to said barrier, wherein said top portion has a top wall connecting downwardly depending side walls that respectively extend to a longitudinal top recess, said resilient clip engaged with said top portion to secure a liner edge to said barrier, said clip having an elongated U-shape with a flat bight extending to opposed legs for engagement with said longitudinal top recesses to trap the liner edge between the clip and the top portion of said member.

15. The barrier of claim 14, wherein said longitudinal ends include connector teeth having through openings that vertically align upon engagement of connector teeth of adjacent members, and a locking pin having a straight portion and an offset handle-lock, said locking pin straight portion being received in said aligned openings of engaged connector teeth and being rotatable to dispose said handle-lock within an adjacent longitudinal top recess.

* * * * *